United States Patent [19]

Coffman

[11] 3,978,842

[45] Sept. 7, 1976

[54] MASONRY BLOCK CUTTER

[76] Inventor: Leon M. Coffman, 19509 Hart St., Reseda, Calif. 91335

[22] Filed: Feb. 27, 1975

[21] Appl. No.: 553,595

[52] U.S. Cl. ..... 125/23 R; 83/694

[51] Int. Cl.[2] ..... B28D 1/32

[58] Field of Search ..... 125/23; 83/600, 694

[56] References Cited

UNITED STATES PATENTS

| | | | |
|---|---|---|---|
| 812,973 | 2/1906 | Barr | 125/23 C |
| 1,906,599 | 5/1933 | Hoffert | 125/23 R |
| 2,482,379 | 9/1949 | Soderman | 125/23 C |
| 2,657,681 | 11/1953 | Gatzke | 125/23 R |
| 3,392,719 | 7/1968 | Clanton | 125/23 R |
| 3,492,984 | 2/1970 | Harper | 125/23 R |
| 3,496,813 | 2/1970 | Valente | 83/694 |

*Primary Examiner*—Harold D. Whitehead
*Attorney, Agent, or Firm*—Alan C. Rose

[57] ABSTRACT

A masonry block cutter includes four blades. The blades are arranged in two pairs with each V-shaped pair being secured together. When cutting a block having a square cross section, the cutter has a generally square configuration, with the opposed pairs of blades being pivoted at one corner of the square and having spaced-apart elongated handles extending parallel to each other and at an angle of about 45° to the adjacent sides, at the opposite corner of the square. Hammer blocks are provided at the intermediate corners of the cutter, so that, when the blades are resiliently held against the block by the grip of one hand at the end of the handles, the mason may strike one of the hammer blocks and cleanly cut the masonry block at the desired point along its length.

10 Claims, 4 Drawing Figures

MASONRY BLOCK CUTTER

BACKGROUND OF THE INVENTION

This invention relates to masonry block cutters.

Up to the present time, when a mason is on the job and has to cut a masonry block, such as an 8 inch × 8 inch × 16 inch block, he frequently will use his mason's chisel or mason's hammer. The results such efforts are usually less than neat, and are frequently ragged in appearance. On larger projects, a central cutting facility, which may include a diamond wheel or saw, may be provided. Each mason must than mark the block, and send it down for cutting; meanwhile his work comes to a complete halt.

OBJECTS OF THE INVENTION

Accordingly, the principal object of the invention is to provide an effective masonry block cutting tool which is sufficiently light weight and inexpensive that each mason can practically and conveniently take it with him on the job where he is working.

SUMMARY OF THE INVENTION

The present invention contemplates the use of two pairs of opposed blades, with the two blades of each pair being oriented approximately at right angles with respect to each other. Arrangements are provided for urging the pairs of blades toward each other in engagement with the masonry block to be cut, at the desired point along its length. Arrangements are also provided for applying additional impulse, preferably in the form of a sharp blow, to the blades, to cut, or sever the masonry block.

In a preferred embodiment of the invention, the blades of each pair are rigidly secured together, and have a generally square or rectangular configuration in engagement with a masonry block. At one corner the two pairs of blades are pivotally connected together, and spaced-apart handles are secured to the respective ends of the pairs of blades at the opposite corner of the square or rectangular configuration. The handles are rigidly connected to the blades and extend out from the blade assembly, so that, when the handles are gripped at the end, corresponding resilient gripping pressure is applied to the masonry block by the blades.

In accordance with the preferred embodiment of the invention the pairs of blades are reinforced at the intersection of the blades making up each pair to receive the blow or additional force impulse needed to sever the block. These reinforcements are designated "hammer blocks" and, when the cutter rests firmly on one of the hammer blocks, while the other is struck a firm blow with a hammer, the masonry block is cleanly severed.

One interesting feature of the invention is that, for cutting the masonry blocks, the blades only have to move toward each other a short distance. For example, in cutting a nominal 8 inch by 8 inch by 16 inch block, the handles would normally only be spaced-apart one-half or three-quarters of an inch (with the blades engaging the four 8 inch sides of the block). However, when the upper hammer block is struck, the block is immediately severed cleanly, even though the blades only move a maximum of one-half to three-quarters of an inch as the handles come together.

Other objects, features and advantages of the invention will become apparent from a consideration of the following detailed description and from the drawings, in which.

Figure 1:
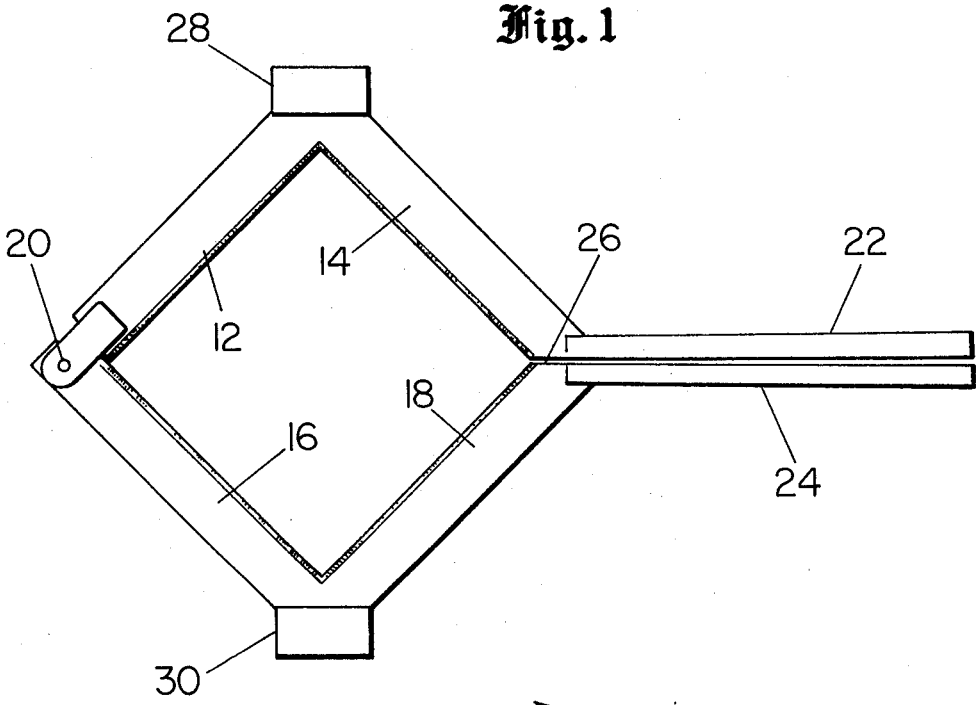
FIG. 1 is a side view of a masonry block cutter illustrating the principles of the invention.
Figure 1:
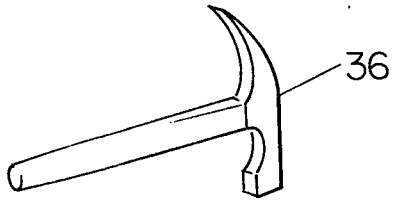

Referring in detail to the drawings, the masonry block cutter of FIG. 1 includes four blades 12, 14, 16, and 18 arranged in a generally square configuration. Blades 12 and 14 form one pair, and blades 16 and 18 are an opposed pair. The two pairs of blades are pivotally secured together at point 20, and are provided with elongated handles 22 and 24.

The square opening is formed to receive a nominal 8 inch × 8 inch × 16 inch block. Such masonry blocks normally have actual dimensions of 7⅝ inch × 7⅝ inch × 15⅝ inch, although they sometimes run as much as ½ inch undersize instead of ⅜ inch under nominal size.

The opening between the blades is such that the handles are spaced-apart at point 26 near the corner of the block by about one-half or three-quarters of an inch, when the blades are in engagement with the block. When the handles are gripped at their ends, the handles have considerable resiliency and thus transmit a strong and firm gripping force to the blades in their engagement with the masonry block.

The entire assembly is made of metal, with the blades preferably being made of hardened steel. The blades are about ¼ inch thick and 1½ inches wide. The handles may be of steel, and suitably have a cross-section of about ¾ inch × ¾ inch, and may be about 10 inches long from the corner of the masonry block.

The masonry cutter is also provided with first and second "hammer blocks", or reinforced hammer receiving members, 28 and 30, located respectively at the intersections of the blades forming the first and second pairs of opposed blades. The hammer blocks are oriented generally parallel with the handles, so that one may be placed on a firm support while the other is struck with a hammer. The blocks 28 and 30 may be about 3 inch by 1½ inch by ¾ thick.

Figure 2:
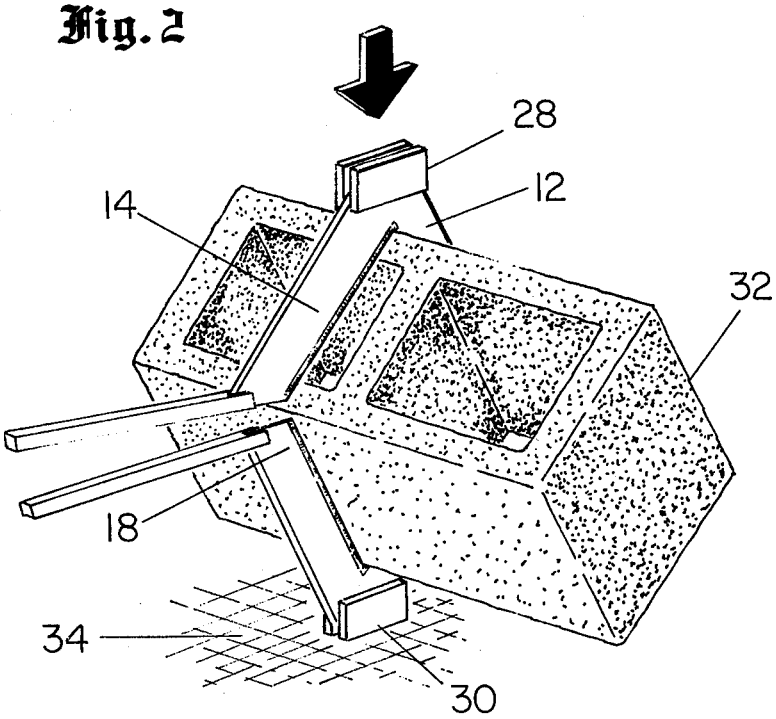
FIG. 2 is an isometric view of the cutter of FIG. 1 as it is used to cut a masonry block.

FIG. 2 shows the masonry cutter in action cutting the block 32. The block 32 is first engaged by the blades 12, 14, 16 and 18 at the point along it length where it is to be cut off. The handles are gripped toward their ends with one hand, thus applying resilient and firm gripping force to the blades, which in turn apply this force to the block. The cutter is then turned so one hammer block 30 rests on a firm support 34, and a firm blow is struck with the mason's hammer 36 to the other hammer block 28.

This cuts or cleaves the block 32 cleanly, with no unsightly irregularities.

Figure 3:
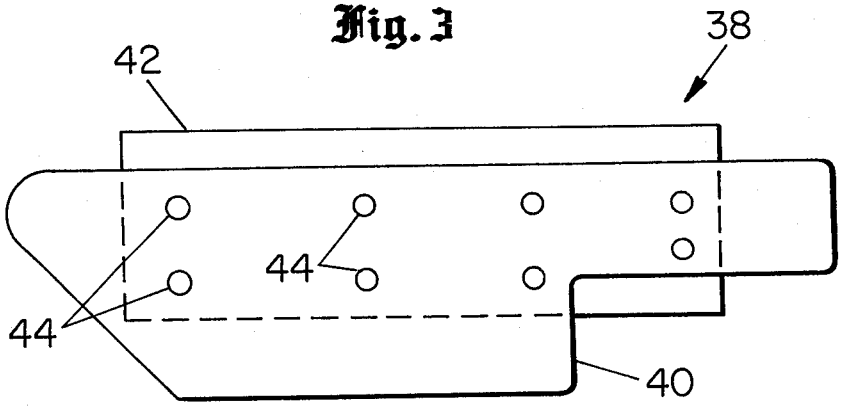
FIG. 3 shows an adapter blade assembly for cutting blocks having a reduced cross-section.

FIG. 3 shows an adapter for blocks of the nominal 6 inch × 8 inch × 16 inch size. These blocks are actually approximately 5⅝ inch × 7⅝ inch × 15⅝ inch in size. Accordingly, the adapter of FIG. 3 is provided to move one blade 2 inches closer to its opposing blade.

The adapter 38 is a sandwich assembly including two outer retention plates 40 and a central blade 42. The sandwich assembly may be held together by any suitable technique, such as by machine screws 44. The two outer plates 40 are spaced-apart by the thickness of the blades 12, 14, etc. The plates 40 are also cut away in certain areas to avoid interference with the hammer block and the pivot enlargements of the blade.

Figure 4:
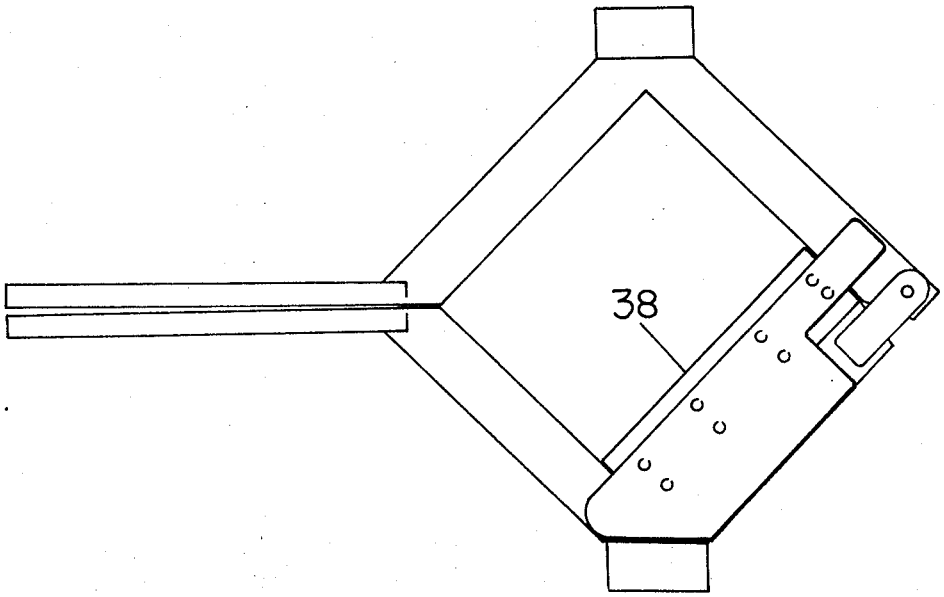
FIG. 4 shows the adapter plate of FIG. 3 assembled with the cutter of FIG. 1.

FIG. 4 shows the plate 38 assembled to the block cutter in preparation for cutting the 6 inch × 8 inch × 16 inch masonry blocks.

In closing and by way of completeness, certain advantages of the present invention relative to prior devices may be noted. Specifically, it is recognized that two bladed cutters of the guillotine and related configurations have been previously proposed, see U.S. Pat. Nos. 2,613,661; 2,710,608; 2,289,985; 2,653,594; and 2,772,671, by way of specific example. The ice cutter of U.S. Pat. No. 1,149,241 should also be mentioned. However, the apparatus disclosed in these references are unduly complex; and none have the two pairs of opposed blades with the arrangements for applying both (1) a firm gripping force and also (2) a sharp force impulse to all four sides of the masonry block. Applicant's arrangements not only apply these dual forces to all four sides of the block to clearly cut the blocks, but do so with a structure of minimum size, complexity, and weight. Accordingly, masons can readily take the cutter of the invention with them to the job site, and conveniently and quickly cut masonry blocks to size.

For completeness, one method of aligning the cutting edges of the four blades may be noted. This may be accomplished by sharpening the blades from one side of the assembly only, as shown in FIG. 1, for example. With all four blades having been sharpened from the near side, as shown in FIG. 1, the cutting edges are all aligned with the rear surface of the blade assemblies.

In conclusion, it is to be understood that, while the foregoing description is illustrative of the principles of the invention, various departures from the specific disclosure may be made without departing from the spirit of the invention. By way of example, but not of limitation, the two blades of each pair of blades could be rigidly bolted together or pivoted instead of the preferred one-piece structure illustrated; and the two pairs of opposed blades could be spring-biased toward each other to engage the masonry block, and then impacted toward one-another, by other mechanical arrangements.

What is claimed is:

1. A lightweight portable masonry block cutter comprising:

means including a first pair of blades connected to each other for engaging two adjacent external sides of the masonry block;

means including a second pair of blades connected to each other for engaging the other two adjacent external sides of the masonry block in opposition to said first pair of blades;

handle means for manually urging said blades into resilient engagement with the masonry block around the exterior of said block, and for angularly orienting said block and cutter, means opposite said handle means for connecting said first pair of blades to said second pair of blades for movement toward and away from each other; and means for receiving an impact to move all four of said opposed blades inwardly for cleanly cutting said masonry block in two.

2. A masonry block cutter as defined in claim 1 wherein the blades of each of said pairs of blades are rigidly connected together.

3. A masonry block cutter as defined in claim 2 wherein said first pair of blades is pivotally connected to said second pair of blades for movement toward and away from said masonry block.

4. A masonry block cutter as defined in claim 3 wherein said means for holding said blades in engagement with the masonry block includes first and second handles secured respectively to the first and second pairs of blades at the ends of said pairs of blades opposite from the pivotal connection of said pairs of blades.

5. A masonry block cutter as defined in claim 4 wherein said handles are resilient and are spaced apart when held together at their ends exert a steady force on said blades against the masonry block.

6. A masonry block cutter as defined in claim 1 wherein said impact applying means includes hammer blocks provided at the corners where the two blades of each of said pairs of blades are interconnected.

7. A masonry cutter as defined in claim 1 wherein means including an adapter blade assembly is provided for sliding over one of said blades to cut different size masonry blocks.

8. A masonry cutter as defined in claim 7 wherein said adapter assembly is a three layer sandwich including a central blade and outer supporting extensions overlying said central blade and holding it in position above and aligned with one blade of said pairs of blades.

9. The masonry cutter as defined in claim 4 wherein the overall configuration of the cutter when engaging a block to be cut is that of a square with two of the sides adjacent one corner spaced-apart and the two handles extending away from said one corner at an angle of approximately 45° relative to the adjacent sides, and extending generally parallel to each other but slightly spaced-apart to provide resilient gripping action.

10. The cutter as defined in claim 1 wherein said blades are made of hardened steel.

* * * * *